US012339080B2

(12) United States Patent
Balhan et al.

(10) Patent No.: US 12,339,080 B2
(45) Date of Patent: Jun. 24, 2025

(54) SAFETY MECHANISM FOR A PISTOL

(71) Applicant: FN HERSTAL S.A., Herstal (BE)

(72) Inventors: Laurent Balhan, Mormont (BE); Dorian Delvaux, Oupeye (BE)

(73) Assignee: FN HERSTAL S.A., Herstal (BE)

( * ) Notice: Subject to any disclaimer, the term of this patent is extended or adjusted under 35 U.S.C. 154(b) by 0 days.

(21) Appl. No.: 18/569,133

(22) PCT Filed: Jun. 10, 2022

(86) PCT No.: PCT/EP2022/065860
§ 371 (c)(1),
(2) Date: Dec. 11, 2023

(87) PCT Pub. No.: WO2022/263322
PCT Pub. Date: Dec. 22, 2022

(65) Prior Publication Data

US 2024/0280339 A1 Aug. 22, 2024

(30) Foreign Application Priority Data

Jun. 14, 2021 (EP) ..... 21179183

(51) Int. Cl.
*F41A 17/40* (2006.01)
*F41A 35/06* (2006.01)

(52) U.S. Cl.
CPC ..... *F41A 17/40* (2013.01); *F41A 35/06* (2013.01)

(58) Field of Classification Search
CPC ..... F41A 17/40; F41A 17/36; F41A 17/34; F41A 17/38; F41A 17/42; F41A 35/06
USPC ..... 42/16, 17, 18, 21, 22, 6, 7, 70.02, 70.01
See application file for complete search history.

(56) References Cited

U.S. PATENT DOCUMENTS 1,352,267 A 9/1920 Lindley
1,638,068 A * 8/1927 Tansley ..... F41A 17/36 89/145
2,115,041 A * 4/1938 Obregon ..... F41A 17/38 89/196
3,857,325 A * 12/1974 Thomas ..... F41A 17/20 89/190

(Continued)

FOREIGN PATENT DOCUMENTS

DE 10120905 A1 * 10/2002 ..... F41A 17/36
DE 10126398 A1 12/2002

(Continued)

*Primary Examiner* — John Cooper
(74) *Attorney, Agent, or Firm* — Kolitch Romano Dascenzo Gates LLC

(57) ABSTRACT

The present disclosure relates to an automatic or semiautomatic pistol including a slide and a magazine. The magazine feeder includes an actuator that controls a slide stop. The slide stop, located rearward of the magazine, is designed to switch from a low to a high position. In its high position, the slide stop locks the slide in a rearward position. The pistol also includes a control lever for the slide stop, which is attached at one end to rotate about a pin forward of the magazine. The control lever includes a feeler that is lifted by the control actuator when the magazine is empty, causing the slide stop to switch from its low to high position. The slide stop may have ambidextrous manual releases rigidly connected to each other across the pistol.

10 Claims, 2 Drawing Sheets

(56) References Cited

U.S. PATENT DOCUMENTS

| | | | | |
|---|---|---|---|---|
| 4,031,648 | A * | 6/1977 | Thomas | F41A 17/36 89/137 |
| 4,549,465 | A * | 10/1985 | Charron | F41A 17/36 89/196 |
| 7,228,780 | B1 * | 6/2007 | Thomele | F41A 17/42 89/190 |
| 11,293,714 | B2 * | 4/2022 | Balhan | F41A 17/46 |
| 2002/0152660 | A1 * | 10/2002 | Fluhr | F41A 17/36 42/70.02 |
| 2013/0152444 | A1 * | 6/2013 | Tatum | F41A 17/56 42/70.01 |
| 2015/0096212 | A1 | 4/2015 | Curry | |
| 2015/0192378 | A1 * | 7/2015 | Hirschheiter | F41A 17/36 42/7 |
| 2017/0234638 | A1 * | 8/2017 | Noonan | F41A 17/36 89/138 |
| 2017/0299303 | A1 * | 10/2017 | Phipps | F41A 17/36 |
| 2018/0259281 | A1 * | 9/2018 | Indruch | F41A 17/38 |

FOREIGN PATENT DOCUMENTS

| | | | |
|---|---|---|---|
| EP | 1566605 | B1 | 5/2007 |
| WO | WO2016076931 | A2 | 5/2016 |

* cited by examiner

SAFETY MECHANISM FOR A PISTOL

TECHNICAL FIELD

The present disclosure relates to an automatic or semi-automatic pistol comprising a slide stop triggered by a magazine feeder.

TECHNOLOGICAL BACKGROUND

Pistols are usually equipped with a function called a "slide stop" used for locking the slide in the rear position when firing when the magazine is empty. Thereby, on the one hand, the shooter can see that his/her magazine is now empty. On the other hand, a faster rearming is possible since the shooter just needs to place a new loaded magazine in the weapon and, either to press a manual stop control, or to slightly back the slide then to release the slide in order to chamber a new ammunition.

Without such a function, the slide would close on an empty chamber at the end of the magazine. The shooter could then believe that the weapon is ready to fire, whereas this would not be the case. An incident could result therefrom for the shooter in a combat situation.

The stop control is usually located on a flank of the weapon, between the slide and the shell so as to be actuated with the thumb of the dominant hand without moving the hand from the firing position.

For a long time, shooters just had a stop control on the left side of the weapon, which is not handy for a left-handed shooter.

In recent years, manufacturers have proposed ambidextrous slide stops with a manual control placed on the left flank of the weapon and another placed on the right flank of the weapon. The goal is, of course, to improve the ergonomics of the weapon. U.S. Pat. No. 7,228,780B1 discloses such an ambidextrous stop consisting of one piece.

Such a type of ambidextrous slide stop generally works less well for a left-handed shooter than for a right-handed shooter. By design, the slide stop only hooks the slide on the left side, i.e. the side on which a right-handed shooter presses. The release of the slide is then more responsive for a right-handed shooter.

On the other hand, when a left-hand shooter presses on the control located to the right of the slide, the entire stop is deformed (bending and twisting) and the left-hand shooter often has to make a bigger movement with the control on the right, which requires a bigger effort, so that the slide catch on the left is retracted enough to release the slide.

It should also be noted that the usual position of the stop control corresponds to the position of the thumb of the dominant hand in the firing position. It is thus common to exert a parasitic pressure of the thumb on the stop during firing. Henceforth the stop is prevented from raising and stopping the slide at the end of the magazine. As described hereinabove, the slide would then be pushed forward, without any cartridge in the chamber while the shooter would be thinking that the weapon is ready to fire. In combat situations, a problematic situation would result therefrom.

SUMMARY

The present disclosure aims to improve the ergonomics and the reliability of a slide stop and of the manual control thereof.

The present disclosure relates to an automatic or semiautomatic pistol comprising:

- a slide;
- a magazine, comprising a feeder pushing ammunition to an ammunition loading area, said feeder comprising a control actuator for a slide stop,
- a slide stop which is arranged at the rear of the magazine and can switch from a low position to a high position, the slide stop comprising a stop surface cooperating with a notch under the slide for locking the slide, in the high position of the slide stop, in a rearward position;
- a control lever for the slide stop, attached at one end, which can rotate about an axis attached to a shell or a frame at the front of the magazine, said control lever for the slide stop comprising a feeler lifted by the control actuator for side stop when the magazine is empty and arranged so as to switchover the slide stop from the low position thereof to the high position thereof;
- wherein the control lever for the slide stop and the slide stop are arranged in such a way that the raising of the lever for the slide stop entails the switchover of the slide stop to a locking position of the slide thereof.

According to preferred embodiments, the pistol comprises one or an appropriate combination of the following features:

- the slide stop is rotatably attached to the shell or to the frame around a slide stop axis;
- the mechanical connection between the slide stop and the control lever for the slide stop is provided by a couple of male/female connectors which fit into each other rotatably;
- the slide stop comprises at least one manual release for the slide stop, arranged on a flank of the gun, at the rear of the magazine;
- the slide stop comprises two manual releases for the slide stop, arranged on both sides of the gun, the two manual releases for the slide stop being linked by an ambidextrous connection extending from one side of the weapon to the other and rigidly attaching the two manual releases for the slide stop;
- a trigger safety is arranged above a trigger guard.

LEGEND OF THE FIGURES

Figure 1:
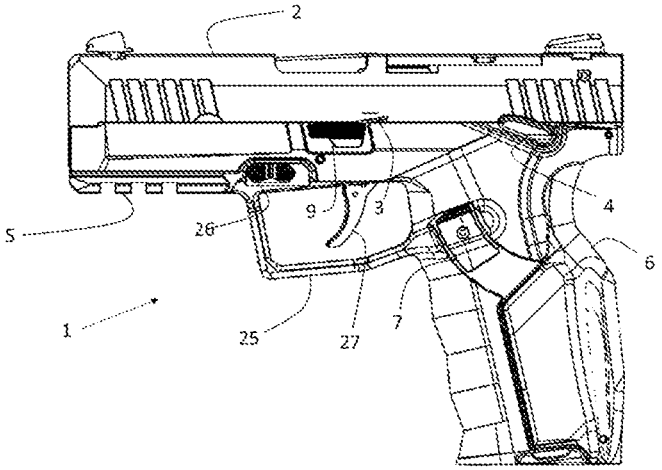
FIG. 1 shows an example of a pistol according to the present disclosure.

1. Pistol
2. Slide
3. Slide stop notch
4. Slide stop manual release
5. Shell
6. Handle
7. Magazine lock control
8. Slide stop control lever
9. Slide stop control pin
10. Slide stop
11. Slide stop pin
12. Slide stop connector

13. Slide stop control connector
14. Slide stop control feeler
15. Stop surface of the slide stop
16. Ambidextrous connection
17. Slide stop spring housing
18. Slide stop pin holes
19. Magazine case
20. Magazine spring
21. Magazine baseplate
22. Magazine feeder
23. Slide stop control actuator
24. Magazine
25. Trigger guard
26. Manual safety control
27. Trigger
28. Frame

DETAILED DESCRIPTION

The present disclosure relates to a slide stop of a pistol 1, for preventing the slide 2 from returning to its closed position when the magazine 24 present in the gun 1 is empty. The slide stop 10 is actuated by a slide stop control lever 8, which is used for raising the slide stop 10 from a low position, leaving the slide 2 free, to a high position where the slide stop 10 stops the slide 2 in the rear position.

The slide stop 10 comprises a stop surface 15 arranged so as to latch the slide 2 in the rear position, via a notch 3 located under the slide 2, when the slide stop is in the upper position.

Figure 2:
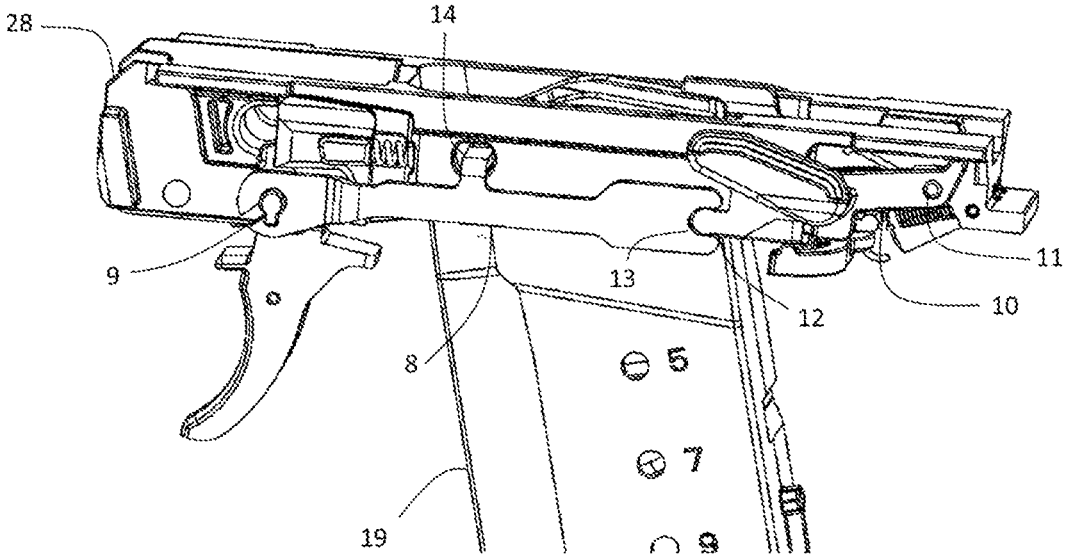
FIG. 2 shows a partial view of a gun according to the invention wherein the slide and the shell have not been shown.
Figure 3:
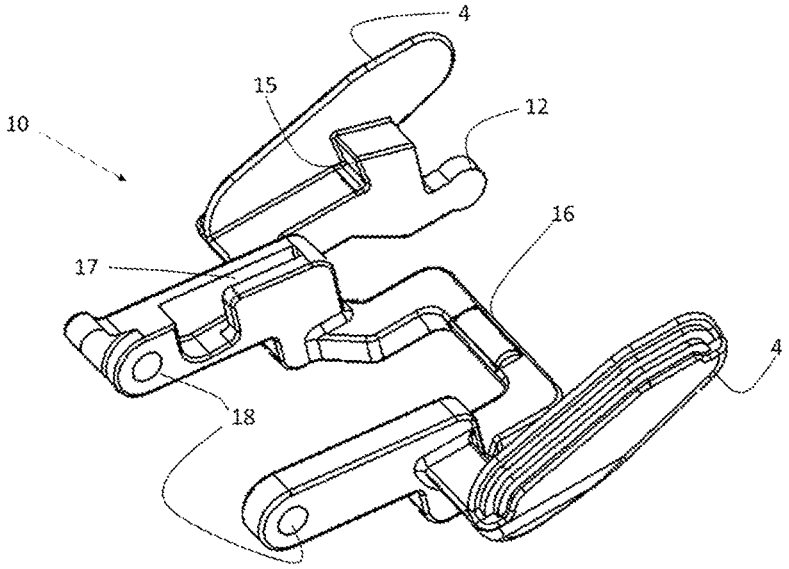
FIG. 3 shows an example of a slide stop according to the present disclosure.
Figure 4:
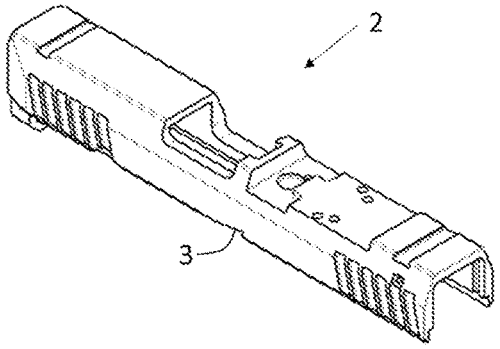
FIG. 4 shows an example of a slide of a pistol according to the present disclosure.
Figure 5:
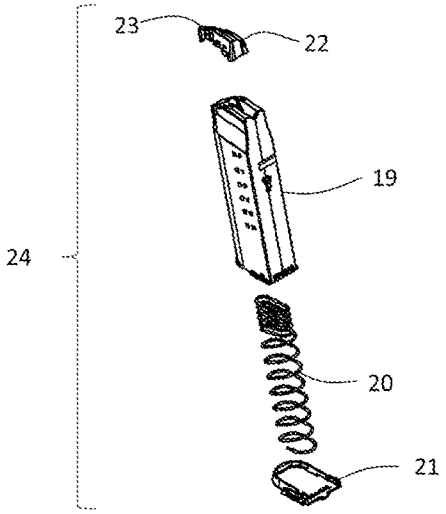
FIG. 5 shows an example of a magazine of a pistol according to the present disclosure.

The raising of the slide stop 10 can either be obtained by an upwards translation movement obtained by sliding in a vertical aperture (not shown) or, preferentially, as shown in FIGS. 2 and 3, by rotation about a pin 11 arranged at the rear of the magazine well and rearwards from the stop surface 15 of the slide stop 10.

In the absence of an upward force exerted by the slide stop control lever 8, the slide stop is pushed downwards by a spring, or any other suitable equivalent means. This spring, in the example of FIGS. 1 to 3, is housed in a housing 17 and rests on the frame 28.

The slide stop control lever 8 is rotatably mounted about a pin 9 located at the front of the magazine well. The pin 9 could e.g. advantageously be a pin common with a pin for the trigger 27. Nevertheless, the lever can also be on a pin independent of the trigger 27. The lever 8 extends from the pin 9 at the front of the magazine to the slide stop 10 at the rear of the magazine. The lever 8 further comprises a feeler 14 for the magazine feeder bearing on an actuator 23 for controlling the slide stop when the magazine is empty.

The actuator 23 generally takes the form of a bearing surface at the front left of the feeder 22 of the magazine. The slide stop control lever 8 is located on the same side as the slide stop actuator, and thus, is generally located on the left flank of the weapon 1. The feeler 14 and the actuator 23 are arranged in such a way that when the feeder 22 reaches the end of the travel thereof after the firing of the last cartridge, the actuator 23 lifts the feeler 14, leading to the rotation of the lever 8, raising the slide stop via an upward-facing support surface of the lever 8, pushing under a corresponding support surface of the slide stop. As shown in FIG. 2, the support can take a more complex form such as the fitting of a male part which fits rotatably into a female part, called a connector 13 for the slide stop and the control connector 12 for the slide stop, respectively.

As will be seen hereinafter, even in the case of a slide stop with ambidextrous control, the slide stop control lever 8 is preferentially arranged only on one flank, and advantageously the stop surface 15 of the slide stop 10 is located on the same side.

Advantageously, the slide stop 10 of the invention comprises two manual controls 4 arranged on the two flanks of the weapon, the two controls being mechanically connected to each other via an ambidextrous connection 16. In such case, both sides of the slide stop 10 are attached to the pin for the slide stop via pin holes 18 arranged on both sides of the slide stop 10. The arrangement of the slide stop 10, and in particular the axis of rotation 11 thereof, at the rear of the weapon, reduces the length of the levers on which the transmission of mechanical stresses from one face to the other takes place, reducing the deformation of the slide stop 10 accordingly. Such reduction in deformation improves ergonomics for left-handed users.

Such rigidity can also advantageously be improved by producing the part by metal injection molding (MIM) rather than by bending sheet metal as in the prior art.

The arrangement of the slide stop at the rear of the weapon advantageously makes it possible to arrange the manual control 4 at the rear, which reduces the risk of the shooter placing his/her hand on top during firing, which would block the rotation of the stop and lead to the malfunction of the stop. A closing of the moving parts on an empty chamber at the end of the magazine, would result therefrom.

Since the zones of manual control 4 of the stop are henceforth in the region traditionally reserved for the manual safety lever, the manual safety mechanism 26 has advantageously been arranged towards the front of the weapon, above the trigger guard 25. (see FIG. 1). The manual safety mechanism is described in more detail in the pending application U.S. Ser. No. 17/238,344.

There is a great ergonomic advantage to such a solution. When the user holds his/her weapon in hand, he/she extends the index finger of his/her dominant hand over the trigger guard 25 so as not to risk pressing on the trigger 27. He/she then has the end of his/her index finger on the manual safety button 26. If he/she has to fire, he/she can then easily actuate the manual safety without taking his/her hand off the handle. Such action is thus much easier and faster than in the traditional case of a safety lever placed at the back of the weapon.

The invention claimed is:

1. An automatic or semiautomatic pistol (1) comprising a slide (2);

a magazine (24) comprising a feeder (22) configured to push ammunition to an ammunition loading area, the feeder (22) including an actuator (23) configured to control a slide stop (10), wherein the slide stop (10) is arranged rearward of the magazine and is configured to switch from a low position to a high position, the slide stop (10) comprising a stop surface (15) configured to cooperate with a notch (3) under the slide to lock the slide (2) in a rearward position when the slide stop is in the high position; and a control lever (8) operatively connected to the slide stop and configured to rotate about a first pin (9) attached to a shell (5) or a frame (28) of the pistol forward of the magazine, the control lever (8) comprising a feeler (14) configured to be lifted by the actuator (23) of the feeder when the magazine is empty, wherein the control lever (8) is configured to transition the slide stop from the low position to the high position;

wherein the slide stop is rotatably attached to the shell (5) or to the frame (28) about a second pin (11) of the slide stop; and wherein the control lever (8) and the slide stop (10) are configured such that raising of the control lever (8) causes a switchover of the slide stop to a locking position of the slide (2).

2. The pistol according to claim 1, wherein the slide stop (10) and the control lever (8) are operatively connected by a pair of pivotably coupled male/female connectors (12,13).

3. The pistol according to claim 1, wherein the slide stop (10) comprises at least one manual release (4) for the slide stop arranged on a flank of the pistol rearward of the magazine (19).

4. The pistol according to claim 3, comprising two manual releases (4) for the slide stop, a respective one of the manual releases arranged on each side of the pistol, the two manual releases (4) for the slide stop being connected by an ambidextrous connection (16) extending from one side of the pistol to the other and rigidly attaching the two manual releases (4) of the slide stop to each other.

5. The pistol according to claim 1, further comprising a trigger safety device (26) arranged above a trigger guard (25) of the pistol.

6. An automatic or semiautomatic pistol (1) comprising a slide (2);

a magazine (24) comprising a feeder (22) configured to push ammunition to an ammunition loading area, the feeder (22) including an actuator (23) configured to control a slide stop (10), wherein the slide stop (10) is arranged rearward of the magazine and is configured to switch from a low position to a high position, the slide stop (10) comprising a stop surface (15) configured to cooperate with a notch (3) under the slide to lock the slide (2) in a rearward position when the slide stop is in the high position; and a control lever (8) operatively connected to the slide stop and configured to rotate about a first pin (9) attached to a shell (5) or a frame (28) of the pistol forward of the magazine, the control lever (8) comprising a feeler (14) configured to be lifted by the actuator (23) of the feeder when the magazine is empty, wherein the control lever (8) is configured to transition the slide stop from the low position to the high position;

wherein the slide stop (10) and the control lever (8) are operatively connected by a pair of pivotably coupled male/female connectors (12,13); and wherein the control lever (8) and the slide stop (10) are configured such that raising of the control lever (8) causes a switchover of the slide stop to a locking position of the slide (2).

7. The pistol according to claim 6, wherein the slide stop is rotatably attached to the shell (5) or to the frame (28) about a second pin (11) of the slide stop.

8. The pistol according to claim 6, wherein the slide stop (10) comprises at least one manual release (4) for the slide stop arranged on a flank of the pistol rearward of the magazine (19).

9. The pistol according to claim 8, comprising two manual releases (4) for the slide stop, a respective one of the manual releases arranged on each side of the pistol, the two manual releases (4) for the slide stop being connected by an ambidextrous connection (16) extending from one side of the pistol to the other and rigidly attaching the two manual releases (4) of the slide stop to each other.

10. The pistol according to claim 6, further comprising a trigger safety device (26) arranged above a trigger guard (25) of the pistol.

* * * * *